US010128588B2

(12) United States Patent
Nakamura

(10) Patent No.: US 10,128,588 B2
(45) Date of Patent: Nov. 13, 2018

(54) CABLE CONNECTING STRUCTURE

(75) Inventor: Mikio Nakamura, Tokyo (JP)

(73) Assignee: OLYMPUS CORPORATION, Tokyo (JP)

( * ) Notice: Subject to any disclaimer, the term of this patent is extended or adjusted under 35 U.S.C. 154(b) by 146 days.

(21) Appl. No.: 13/525,410

(22) Filed: Jun. 18, 2012

(65) Prior Publication Data

US 2012/0258613 A1 Oct. 11, 2012

Related U.S. Application Data

(63) Continuation of application No. PCT/JP2010/072017, filed on Dec. 8, 2010.

(30) Foreign Application Priority Data

Dec. 24, 2009 (JP) ..... 2009-293444

(51) Int. Cl.
*H01R 12/00* (2006.01)
*H01R 12/59* (2011.01)
*H01R 12/62* (2011.01)

(52) U.S. Cl.
CPC ..... *H01R 12/598* (2013.01); *H01R 12/62* (2013.01)

(58) Field of Classification Search
CPC ..... H01R 12/62; H01R 12/598
USPC ..... 174/117 F; 439/63
See application file for complete search history.

(56) References Cited

U.S. PATENT DOCUMENTS 3,818,122 A * 6/1974 Luetzow ..... H01B 7/04 174/117 FF
3,878,341 A * 4/1975 Balde ..... 307/113
4,812,135 A * 3/1989 Smith ..... H01B 7/0838 174/117 F
5,709,570 A * 1/1998 Takayama ..... 439/681
6,344,616 B1 * 2/2002 Yokokawa ..... 174/117 F
6,452,812 B1 * 9/2002 Saito et al. ..... 361/818
6,606,787 B2 * 8/2003 Okumura et al. ..... 29/828
6,612,863 B2 * 9/2003 Terai ..... 439/492
6,837,741 B2 * 1/2005 Kuwahara ..... 439/497
6,842,093 B2 * 1/2005 Tamaki ..... H01P 5/085 333/260

(Continued)

FOREIGN PATENT DOCUMENTS

JP 11-250954 9/1999
JP 2001-068175 3/2001
JP 2009-123459 6/2009

OTHER PUBLICATIONS

International Search Report dated Jan. 11, 2011 issued in PCT/JP2010/072017.

(Continued)

*Primary Examiner* — William H Mayo, III
*Assistant Examiner* — Rhadames J Alonzo Miller
(74) *Attorney, Agent, or Firm* — Scull, Scott, Murphy & Presser, P.C.

(57) ABSTRACT

A cable connecting structure includes a cable that includes a conductive film formed on a surface of a core line exposed at a distal end surface, and a substrate that includes an electrode formed on a predetermined connection side surface for connecting the cable. The distal end surface of the cable and the connection side surface of the substrate are arranged so as to face each other. The conductive film formed on the surface of the core line and the electrode are connected by a conductive material.

5 Claims, 5 Drawing Sheets

(56) References Cited

U.S. PATENT DOCUMENTS

| | | | | |
|---|---|---|---|---|
| 6,857,898 | B2 * | 2/2005 | Engquist | H01R 9/0515 439/493 |
| 7,628,647 | B2 * | 12/2009 | Semba et al. | 439/579 |
| 7,973,239 | B2 * | 7/2011 | Koyama et al. | 174/74 R |
| 2004/0072468 | A1 * | 4/2004 | Engquist | H01R 9/0515 439/493 |
| 2007/0095555 | A1 * | 5/2007 | Venaleck | 174/75 C |
| 2008/0139046 | A1 * | 6/2008 | Semba et al. | 439/579 |
| 2008/0235945 | A1 * | 10/2008 | Nakamae | 29/868 |
| 2009/0120662 | A1 * | 5/2009 | Tanaka | H01R 12/592 174/113 R |

OTHER PUBLICATIONS

European Search Report dated Mar. 27, 2013 from corresponding European Patent Application No. 10 83 9188.9.

* cited by examiner

CABLE CONNECTING STRUCTURE

CROSS-REFERENCE TO RELATED APPLICATIONS

This application is a continuation of PCT international application Ser. No. PCT/JP2010/072017 filed on Dec. 8, 2010 which designates the United States, incorporated herein by reference, and which claims the benefit of priority from Japanese Patent Application No. 2009-293444, filed on Dec. 24, 2009, incorporated herein by reference.

BACKGROUND OF THE INVENTION

1. Field of the Invention

The present invention relates to a cable connecting structure for connecting a cable to a substrate.

2. Description of the Related Art

A well-known coaxial cable connecting structure includes a printed substrate having a slit formed on an upper surface thereof and connection patterns formed on both sides of the slit for connecting an external conductor (see Japanese Patent Application Laid-open No. 2001-68175). The technology of Japanese Patent Application Laid-open No. 2001-68175 enables placing the external conductor of the coaxial cable in the slit formed on the printed substrate and connecting the external conductor to the connection patterns on both sides of the slit; therefore, the height necessary for attaching the coaxial cable is reduced by the depth of the slit.

SUMMARY OF THE INVENTION

A cable connecting structure according to one aspect of the present invention includes: a cable that includes a conductive film formed on a surface of a core line exposed at a distal end surface; and a substrate that includes an electrode formed on a predetermined connection side surface for connecting the cable. The distal end surface of the cable and the connection side surface of the substrate are arranged so as to face each other. The conductive film formed on the surface of the core line and the electrode are connected by a conductive material.

A cable connecting structure according to another aspect of the present invention includes: a cable that includes a core line exposed at a distal end surface; and a substrate that includes an electrode formed on a predetermined connection side surface for connecting the cable. The distal end surface of the cable and the connection side surface of the substrate are connected by a conductive material.

The above and other features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
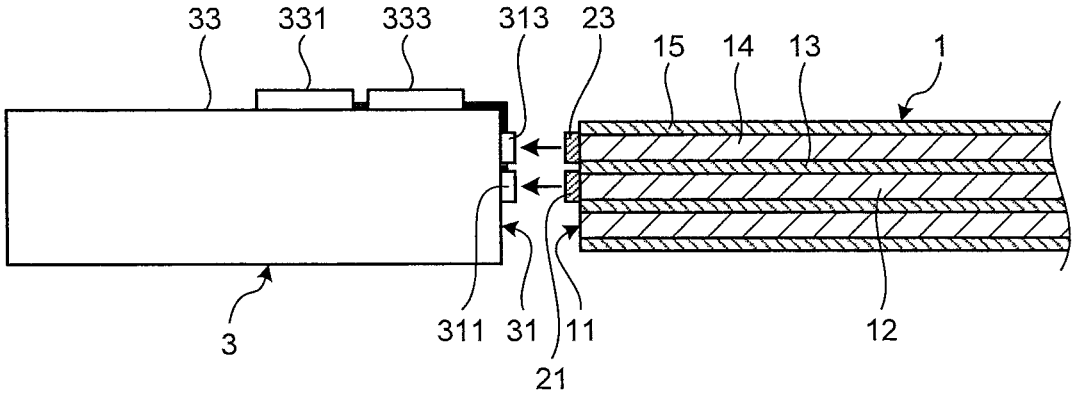
FIG. 1 is a partial cross-sectional view of a cable connecting structure according to a first embodiment.

Preferred embodiments of a cable connecting structure according to the present invention will be explained below with reference to the accompanying drawings. It should be noted that the present invention is not limited to the following embodiments. The same components illustrated in the drawings are denoted with the same reference numerals.

First Embodiment

Figure 2:
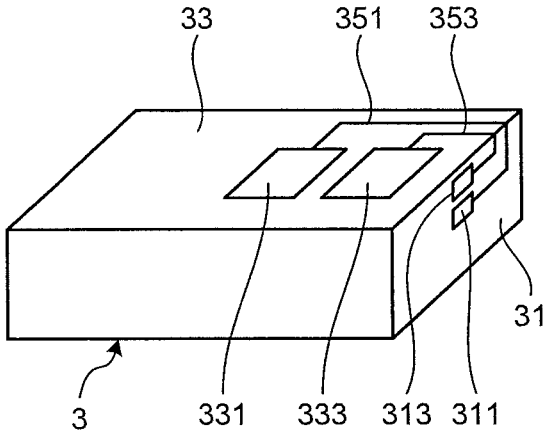
FIG. 2 is a perspective view of the configuration of a substrate according to the first embodiment.

FIG. 1 is a partial cross-sectional view of a cable connecting structure according to a first embodiment. FIG. 2 is a perspective view of the configuration of a substrate 3 to which a coaxial cable 1 is connected according to the cable connecting structure of the first embodiment. As illustrated in FIG. 1, with the cable connecting structure, a distal end surface 11 of the coaxial cable 1 and any one of side surfaces (connection side surface) 31 of the substrate 3 are arranged so as to face each other and are then connected to each other.

The coaxial cable 1 includes an external conductor 14 that is formed around the outer circumference of a center conductor 12 with an inner insulator 13 therebetween. The external conductor 14 is a shielded line and the center conductor is a core line. The coaxial cable 1 further includes an external insulator 15 around the outer circumference of the external conductor 14. A conductive film 21 is formed on a part of the center conductor 12 exposed at the distal end surface 11 of the coaxial cable 1 to flatten the exposed part (the distal end) of the center conductor 12. Moreover, a conductive film 23 is concentrically formed along a part of the external conductor 14 that is exposed to flatten the exposed part (the distal end) of the external conductor 14. The conductive films 21 and 23 are metallic films formed by electrolytic plating, non-electrolytic plating, or spattering. The conductive films 21 and 23 can be either single layered or multilayered. An Au→Ni multilayered film, in which the Au layer is outermost, is preferable because the strength of the joint with the connection side surface 31 of the substrate 3 is increased. If a Ni—Au multilayered film is used, connection to the connection side surface 31 of the substrate 3 can be made in various manners that include not only a later-described connection using an anisotropic conductive material, such as ACF and ACP, but also a solder bump connection and an Au bump connection and the variety of connection manners is increased.

As illustrated in FIG. 2, the substrate 3 includes a center conductor connecting electrode 311 and an shielded line conductor connecting electrode or an external conductor connecting electrode 313 that are formed on the connection side surface 31 and two electrodes 331 and 333 that are formed on a main surface 33 (upper surface). The main surface 33 is a functional surface of the substrate with wires, etc., formed thereon; and the connection side surface 31 is a surface perpendicular to the main surface. As illustrated in FIG. 1, when the connection side surface 31 and the distal end surface 11 are arranged so as to face each other, the center conductor connecting electrode 311 formed on the connection side surface 31 is formed at a position opposed to the conductive film 21 formed on the exposed part of the center conductor 12 as described above. Moreover, the external conductor connecting electrode 313 is formed at a position opposed to the conductive film 23 that is formed on the exposed part of the external conductor 14. As illustrated in FIG. 2, the center conductor connecting electrode 311 of the connection side surface 31 is connected to the electrode 331 of the main surface 33 via a wiring pattern 351 that is formed between them; and the external conductor connecting electrode 313 of the connection side surface 31 is connected to the electrode 333 of the main surface 33 via a wiring pattern 353 that is formed between them. The wiring patterns 351 and 353 are covered with an insulator layer for protection, though the insulator layer is not illustrated.

The distal end surface 11 of the coaxial cable 1 is electrically and physically connected to the connection side surface 31 of the substrate 3 by an anisotropic conductive material (not shown), such as ACF and ACP. That is, in order to connect them, the distal end surface 11 and the connection side surface 31 are first arranged so as to face each other with an anisotropic conductive material therebetween; the conductive film 21 faces the center conductor connecting electrode 311; and the conductive film 23 faces the external conductor connecting electrode 313. After that, heat and pressure are applied to the anisotropic conductive material, with which the conductive film 21 is connected to the center conductor connecting electrode 311 and the conductive film 23 is connected to the external conductor connecting electrode 313; thus, the distal end surface 11 is joined to the connection side surface 31. Solder bumps and Au bumps can be used to connect the conductive film 21 to the center conductor connecting electrode 311 or to connect the conductive film 23 to the external conductor connecting electrode 313.

As described above, according to the first embodiment, the conductive film 21 is formed on a part of the center conductor 12 that is exposed at the distal end surface 11 of the coaxial cable 1 to flatten the center conductor 12 and the conductive film 23 is formed on a part of the external conductor 14 that is exposed at the distal end surface 11 to flatten the external conductor 14, while the center conductor connecting electrode 311 and the external conductor connecting electrode 313 are formed on the connection side surface 31 of the substrate 3. Then, the distal end surface 11 is joined to the connection side surface 31 with, for example, an anisotropic conductive material between them. With this configuration, the height of the attaching portion of the coaxial cable 1 to the substrate 3 decreases to a value equal to or less than the thickness of the substrate 3 or the outer diameter of the coaxial cable 1. With the example of FIG. 1, because the thickness of the substrate 3 is greater than the outer diameter of the coaxial cable 1, the height of the attaching portion of the coaxial cable 1 to the substrate 3 decreases to a value equal to or less than the thickness of the substrate 3. Therefore, it is possible to connect the coaxial cable 1 to the substrate 3 without increasing the height of the attaching portion of the coaxial cable 1. This cable connecting structure can be used, for example, when a coaxial cable is connected to an ultrasound wave generator of an ultrasound endoscope.

Second Embodiment

Figure 3:
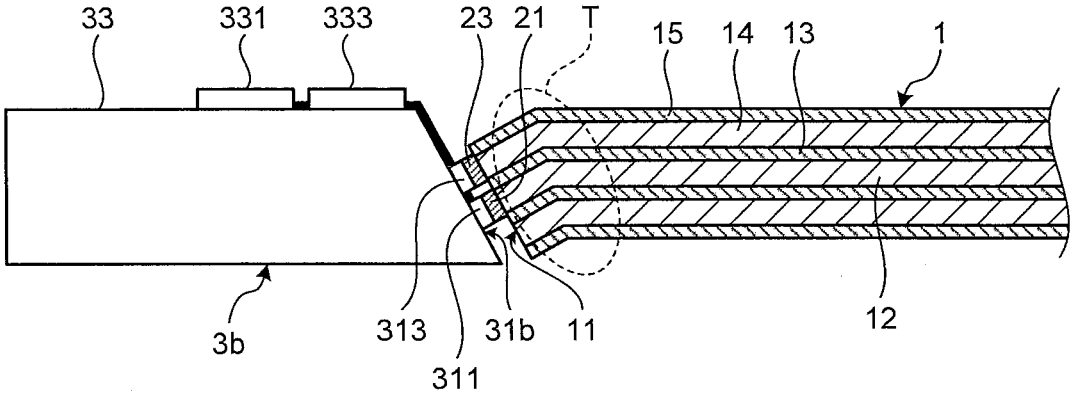
FIG. 3 is a partial cross-sectional view of a cable connecting structure according to a second embodiment.

FIG. 3 is a partial cross-sectional view of a cable connecting structure according to a second embodiment. The same components illustrated in FIG. 3 as those of the first embodiment are denoted with the same reference numerals. As illustrated in FIG. 3, in the second embodiment, a connection side surface 31*b* of a substrate 3*b* is formed as an inclined surface: the center conductor connecting electrode 311 and the external conductor connecting electrode 313 are formed on the inclined connection side surface 31*b*. The substrate 3*b* is, herein, a silicon substrate. It is possible to form the inclined connection side surface 31*b*, for example, by etching a predetermined side of the substrate 3*b* using anisotropic etching. After that, the electrodes 331 and 333 are formed on the main surface 33 and the center conductor connecting electrode 311 and the external conductor connecting electrode 313 are formed on the connection side surface 31*b*.

The distal end surface 11 of the coaxial cable 1 is electrically and physically connected to the connection side surface 31*b* of the substrate 3*b* by an anisotropic conductive material (not shown), such as ACF, in a manner similar to the first embodiment. That is, in order to connect them, the distal end surface 11 and the connection side surface 31*b* are first arranged so as to face each other with an anisotropic conductive material therebetween; the conductive film 21 faces the center conductor connecting electrode 311; and the conductive film 23 faces the external conductor connecting electrode 313. After that, heat and pressure are applied to the anisotropic conductive material, with which, the conductive film 21 is connected to the center conductor connecting electrode 311 and the conductive film 23 is connected to the external conductor connecting electrode 313; thus, the distal end surface 11 is joined to the connection side surface 31*b*.

In the second embodiment, after the distal end surface 11 is joined to the connection side surface 31*b* as described above, the coaxial cable 1 is bent at a distal end nearby T that is encircled by the dotted line of FIG. 3. In the second embodiment, because the coaxial cable 1 is bent at the distal end nearby T in the above manner, the height of the attaching portion of the coaxial cable 1 to the substrate 3*b* decreases to a value equal to or less than the thickness of the substrate 3*b*.

As described above, the second embodiment has the same effect of the first embodiment. Moreover, because the connection side surface 31*b* of the substrate 3*b* is an inclined surface, it is possible to form the electrodes 331 and 333 on the main surface 33 and the center conductor connecting electrode 311 and the external conductor connecting electrode 313 on the connection side surface 31*b* at the same time during the same process, which reduces the manufacture costs.

The substrate 3*b* is not limited to a silicon substrate. It can also be, for example, a ceramic substrate, etc. If the substrate 3*b* is a ceramic substrate, a ceramic layer that has an electrode layer formed at an edge part thereof can be formed as an electrode that is formed on a connection side surface (inclined surface) to which the coaxial cable 1 is connected.

Third Embodiment

Figure 4:
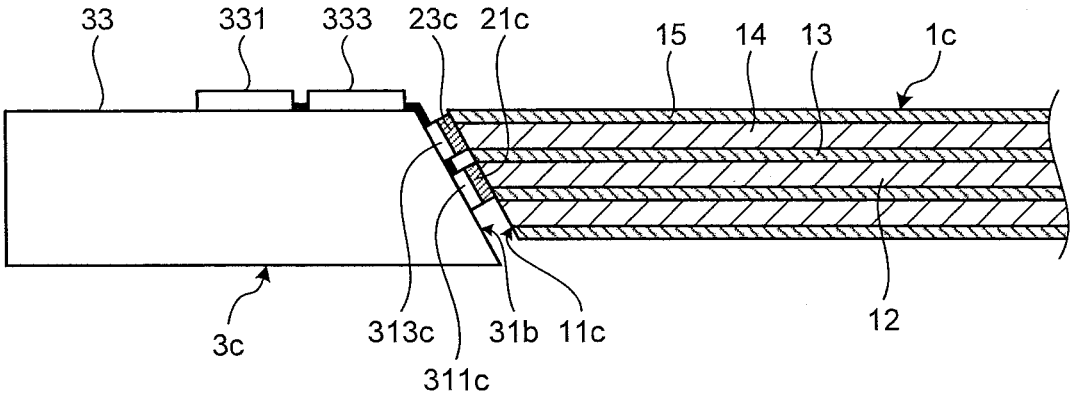
FIG. 4 is a partial cross-sectional view of a cable connecting structure according to a third embodiment.

FIG. 4 is a partial cross-sectional view of a cable connecting structure according to a third embodiment. The same components illustrated in FIG. 4 as those of the second embodiment are denoted with the same reference numerals. As illustrated in FIG. 4, in the third embodiment, in the same manner as in the second embodiment, the connection side surface 31*b* of a substrate 3*c* is formed as an inclined surface, while a distal end surface 11*c* of a coaxial cable 1*c* is formed as an inclined surface that has an angle substantially equal to the angle of the connection side surface 31*b*.

A conductive film 21*c* is formed on a part of the center conductor 12 that is exposed at the distal end surface 11*c* of the coaxial cable 1*c* to flatten the exposed part (the distal end) of the center conductor 12 at the angle of the connection side surface 31*b*. Moreover, a conductive film 23*c* is concentrically formed along a part of the external conductor 14 that is exposed to flatten the exposed part (the distal end) of the external conductor 14 at the angle of the connection side surface 31*b*.

Because the distal end surface 11*c* of the coaxial cable 1*c* is an inclined surface and the conductive films 21*c* and 23*c* are formed at the angle of the distal end surface 11*c*, i.e., the angle of the connection side surface 31*b* of the substrate 3*c*, the areas of the conductive films 21*c* and 23*c* are larger than those of the conductive films 21 and 23 of the first and second embodiments. In the third embodiment, electrodes 311*c* and 313*c* that are formed on the connection side surface 31*b* have larger areas than those of the electrodes of the first and second embodiments in accordance with the areas of the conductive films 21*c* and 23*c*.

The distal end surface 11*c* of the coaxial cable 1*c* is electrically and physically connected to the connection side surface 31*b* of the substrate 3*c* by an anisotropic conductive material (not shown), such as ACF, in a manner similar to the first embodiment. That is, in order to connect them, the distal end surface 11*c* and the connection side surface 31*b* are first arranged so as to face each other with an anisotropic conductive material therebetween; the conductive film 21*c* faces the center conductor connecting electrode 311*c*; and the conductive film 23*c* faces the external conductor connecting electrode 313*c*. After that, heat and pressure are applied to the anisotropic conductive material, with which the conductive film 21*c* is connected to the center conductor connecting electrode 311*c* and the conductive film 23*c* is connected to the external conductor connecting electrode 313*c*; thus, the distal end surface 11*c* is joined to the connection side surface 31*b*.

As described above, the third embodiment has the same effects of the first and second embodiments. Moreover, because the distal end surface 11*c* of the coaxial cable 1*c* is an inclined surface that has an angle substantially equal to the angle of the connection side surface 31*b* of the substrate 3*c*, it is possible to increase the areas of the conductive films 21*c* and 23*c* to be larger than those of the conductive films of the first and second embodiments. Moreover, it is possible to increase, in accordance with the areas of the conductive films 21*c* and 23*c*, the areas of the center conductor connecting electrode 311*c* and the external conductor connecting electrode 313*c* on the connection side surface 31*b* to be larger than those of the electrodes of the first and second embodiments. With this configuration, the area where the conductive film 21*c* is connected to the center conductor connecting electrode 311*c* and the area where the conductive film 23*c* is connected to the external conductor connecting electrode 313*c* are increased and the connection strength is increased.

Fourth Embodiment

Figure 5:
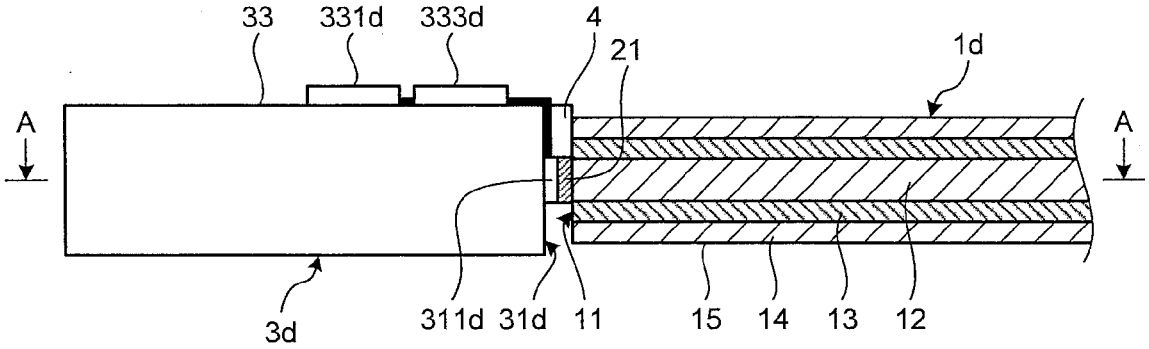
FIG. 5 is a partial cross-sectional view of a cable connecting structure according to a fourth embodiment.
Figure 6:
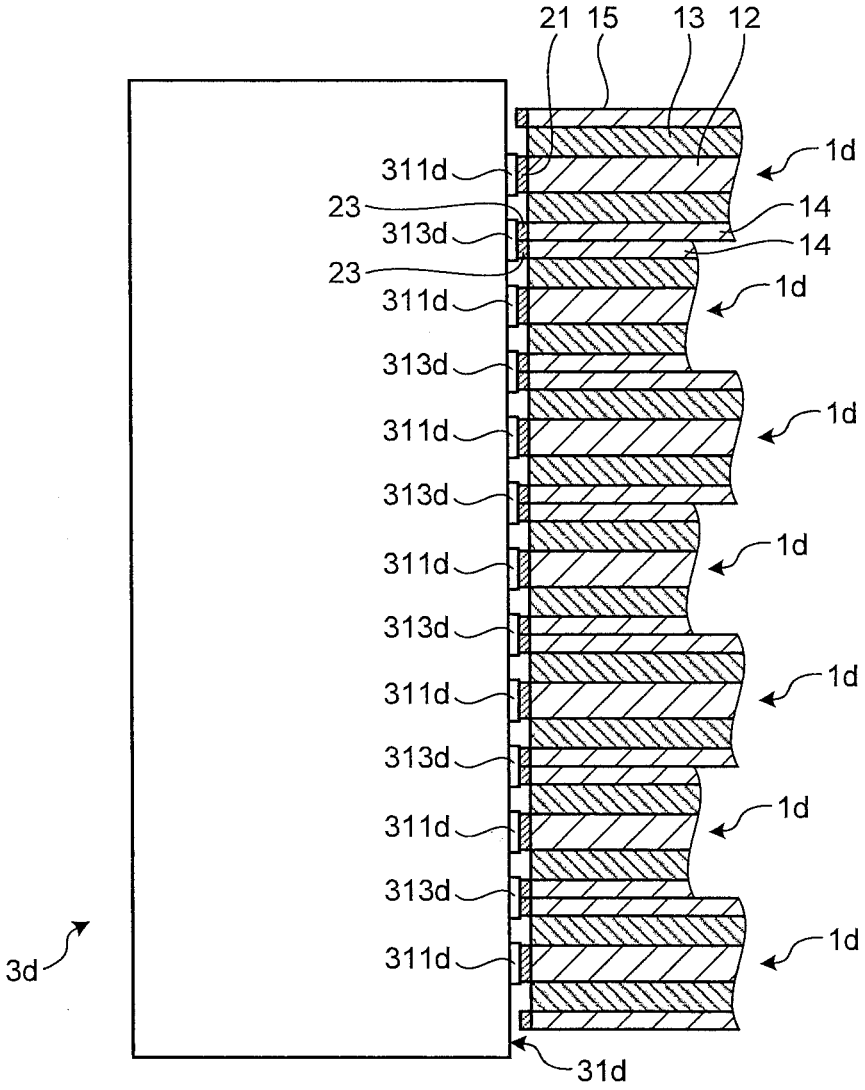
FIG. 6 is a cross-sectional view along the line A-A of FIG. 5.
Figure 7:
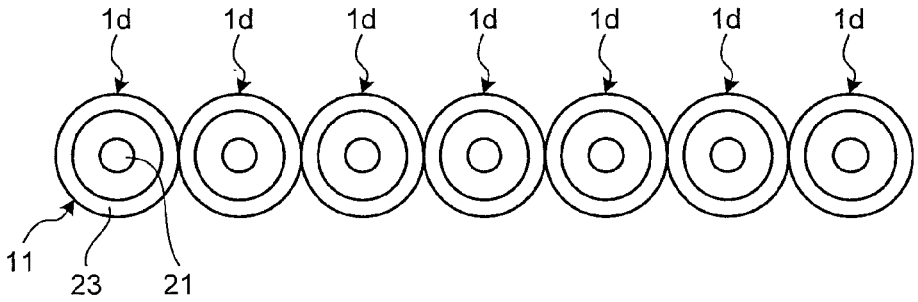
FIG. 7 is a diagram of the distal end surfaces of coaxial cables that are connected to a substrate with the cable connecting structure according to the fourth embodiment.
Figure 8:
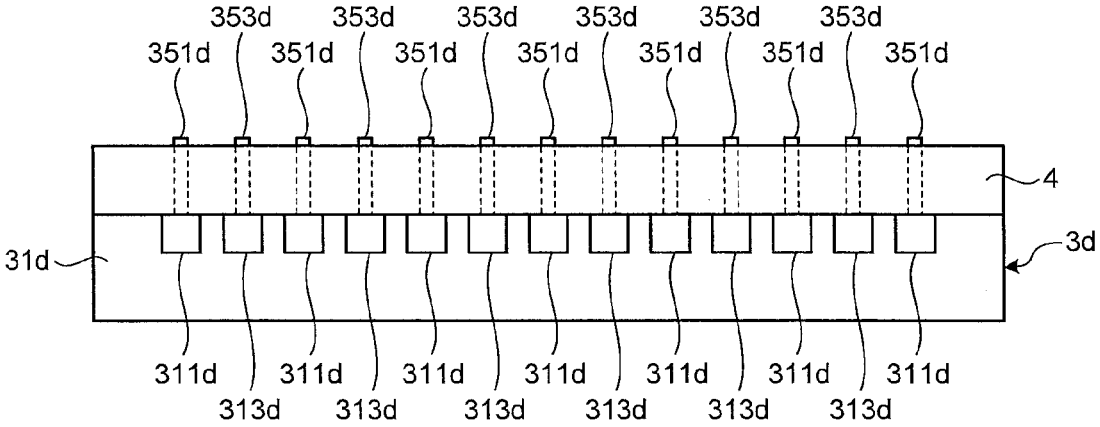
FIG. 8 is a plan view of a connection side surface of the substrate to which the coaxial cables are connected.

In the first to third embodiments, examples are described that a single coaxial cable is connected to a substrate. In contrast, the present invention can be applied to an example that two or more coaxial cables are connected to a substrate. FIG. 5 is a partial cross-sectional view of a cable connecting structure according to a fourth embodiment; and FIG. 6 is a cross-sectional view along the line A-A of FIG. 5. FIG. 7 is a diagram of the distal end surfaces 11 of the coaxial cables 1*d* (seven cables are illustrated) that are connected to a substrate 3*d* with the cable connecting structure according to the fourth embodiment. Although, in this example, the seven coaxial cables 1*d* are connected, the number of the connected coaxial cables 1*d* is not limited specifically and it is applicable to any example that two or more coaxial cables are connected. FIG. 8 is a plan view of a connection side surface 31*d* of the substrate 3*d* to which the coaxial cables 1*d* are connected.

As illustrated in FIG. 5, each of the coaxial cables 1*d* has the same configuration as that of the first embodiment. Each of the coaxial cables 1*d* includes the external conductor 14 that is formed around the outer circumference of the center conductor 12 with the inner insulator 13 therebetween. The external conductor 14 is a shielded line and the center conductor is a core line. In the fourth embodiment, as illustrated in FIG. 7, for example, the seven coaxial cables 1*d* that are aligned in parallel are connected to the substrate 3*d*. The conductive film 21 is formed on a part of the center conductor 12 of each of the coaxial cables 1*d* that is exposed at the distal end surface 11 in the same manner as in the first embodiment to flatten the exposed part (the distal end) of the center conductor 12. Moreover, the conductive film 23 is formed concentrically along a part of the external conductor 14 that is exposed to flatten the exposed part (the distal end) of the external conductor 14.

As illustrated in FIG. 8, seven center conductor connecting electrodes 311*d* and six external conductor connecting electrodes 313*d* are formed alternately on the connection side surface 31*d* of the substrate 3*d*. The center conductor connecting electrodes 311*d* are used to connect the center conductors 12 of the coaxial cables 1*d*. The center conductor connecting electrodes 311*d* are connected to electrodes 331*d* on the main surface 33 (see FIG. 5) via wiring patterns 351*d*. The external conductor connecting electrodes 313*d* are used to connect the external conductors 14 of the coaxial cables 1*d*. The external conductor connecting electrodes 313*d* are connected to electrodes 333*d* on the main surface 33 (see FIG. 5) via wiring patterns 353*d*.

The pitch between the center conductor connecting electrode 311*d* and the external conductor connecting electrode 313*d* is set in accordance with the connection pitch of the coaxial cables 1*d*. As illustrated in FIG. 6, as described above, when the connection side surface 31*d* and each distal end surface 11 are arranged so as to face each other, the center conductor connecting electrodes 311*d* formed on the connection side surface 31*d* are formed at positions opposed to the conductive films 21 formed on the exposed parts of the center conductors 12, respectively. The size of the center conductor connecting electrodes 311*d* is set in accordance with, for example, the inner diameter of the external conductors 14. More particularly, the center conductor connecting electrodes 311*d* are formed such that, for example, the length of the diagonal line is less than the inner diameter of the external conductors 14 and greater than the outer diameter of the center conductors 12. With this configuration, a short circuit cannot occur caused by a contact of the center conductor connecting electrodes 311*d* to the external conductors 14.

The external conductor connecting electrodes 313*d* are formed at positions opposed to the conductive films 23 formed on the exposed parts of the external conductors 14, respectively. More particularly, the width of each of the external conductor connecting electrodes 313*d* is set depending on the width of the external conductors 14 in a radial direction so as to face the external conductors 14 of adjacent coaxial cables 1*d*, so that the external conductors 14 of adjacent coaxial cables 1*d* face the same external conductor connecting electrode 313*d*. The size of each of the external conductor connecting electrodes 313*d* is set in accordance with, for example, the diameter of the center conductor 12 and the diameter of the external conductor 14. For example, each of the external conductor connecting electrodes 313*d* is formed such that the length of each side is less than the width between the outer circumference of the center conductor 12 and the outer circumference of the external conductor 14 in the radial direction. With this configuration, a short circuit cannot occur caused by a contact of the external conductor connecting electrodes 313*d* to the center conductors 12.

Moreover, an insulator layer 4 is formed on the connection side surface 31*d* of the substrate 3*d* in a section upward of the center conductor connecting electrodes 311*d* and the external conductor connecting electrodes 313*d* to cover the wiring patterns 351*d* and 353*d*. As illustrated in FIG. 5, when the coaxial cables 1*d* are connected to the substrate 3*d*, the insulator layer 4 is between the wiring patterns 351*d* and 353*d* and the distal end surfaces 11 of the coaxial cables 1*d*. Therefore, occurrence of a short circuit is prevented caused by a contact of the wiring patterns 351*d* and 353*d* to the external conductors 14 of the coaxial cables 1*d* or the like.

The distal end surface 11 of each of the coaxial cables 1*d* is electrically and physically connected to the connection side surface 31*d* of the substrate 3*d* by an anisotropic conductive material (not shown), such as ACF, in a manner similar to the first embodiment. That is, in order to connect them, the distal end surface 11 and the connection side surface 31*d* are arranged so as to face each other with an anisotropic conductive material therebetween. Then, as illustrated in FIG. 6, the conductive film 21 that is formed on the center conductor 12 of each of the coaxial cables 1*d* faces the center conductor connecting electrode 311*d*; and the conductive film 23 that is formed on the external conductor 14 of each of the coaxial cables 1*d* faces the external conductor connecting electrode 313*d*. After that, heat and pressure are applied to the anisotropic conductive material, with which the conductive films 21 are connected to the center conductor connecting electrodes 311*d* and the conductive films 23 are connected to the external conductor connecting electrodes 313*d*; thus, the distal end surfaces 11 are connected to the connection side surface 31*d*.

As described above, according to the fourth embodiment, it is possible to connect the coaxial cables 1*d* to the substrate 3*d* without increasing the height of the attaching portion of the coaxial cables 1*d*.

Although examples are described in the above embodiments that a coaxial cable(s) is connected to a substrate, the present invention is not limited thereto. It is also applicable to any type of cables other than coaxial cables.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cable connecting structure, comprising:

a plurality of coaxial cables that are arranged next to one another in a first direction, each of the plurality of coaxial cables including a core line and a shield line formed around an outer circumference of the core line with an inner insulator therebetween;

a substrate including:

first and second main surface electrodes each formed on a main surface of the substrate, and first and second connection electrodes that are electrically connected with the core line and the shield line, respectively, of each of the plurality of coaxial cables, the first and second connection electrodes being formed on a connection surface of the substrate, the connection surface being a side surface in relation to the main surface;

a first conductive film formed on a surface of the core line of each of the plurality of coaxial cables, the first conductive film being exposed at a distal end surface of each of the plurality of coaxial cables, the distal end surface being arranged so as to face the connection surface of the substrate;

a second conductive film formed on a surface of the shield line of each of the plurality of coaxial cables, the second conductive film being exposed at the distal end surface of each of the plurality of coaxial cables;

a first wiring pattern that electrically connects the first main surface electrode and at least one of the first connection electrodes corresponding to one of the plurality of coaxial cables, at least part of the first wiring pattern extending on the connection surface in a second direction perpendicular to the first direction;

a second wiring pattern that electrically connects the second main surface electrode and at least one of the second connection electrodes corresponding to one of the plurality of coaxial cables, at least part of the second wiring pattern extending on the connection surface in the second direction; and an electrically insulating layer provided between at least portions of the first and second wiring patterns that extend on the connection surface in the second direction and the distal end surface of each of the plurality of coaxial cables, along a third direction in which the distal end surface faces the connection surface of the substrate, so as to electrically insulate the first and second wiring patterns from the distal end surface of each of the plurality of coaxial cables, wherein the first and second connection electrodes are connected with the first and second conductive films, respectively, by an electrically conductive material, and a length of each of the second connection electrodes in the first direction is set depending on a length of the shield lines in the first direction such that the second connection electrodes connect two shield lines from adjacent coaxial cables of the plurality of coaxial cables.

2. The cable connecting structure according to claim 1, wherein the side surface of the substrate is a surface perpendicular to the main surface of the substrate.

3. The cable connecting structure according to claim 1, wherein surfaces of the first and second conductive films formed on the surface of the core line and on the surface of the shield line, respectively, are flat surfaces.

4. The cable connecting structure according to claim 1, wherein the main surface is a functional surface having at least an area for an electrical or electric element to be placed on, and the connection surface is one of a plurality of the side surfaces that intersect with the main surface.

5. The cable connecting structure according to claim 1, wherein the connection surface is formed as an inclined surface, and the distal end surface of the plurality of coaxial cables are formed as another inclined surface that has an angle substantially equal to an angle of the connection side surface of the substrate.

* * * * *